US009377805B2

(12) United States Patent
Barrett, Jr. et al.

(10) Patent No.: US 9,377,805 B2
(45) Date of Patent: Jun. 28, 2016

(54) PROGRAMMABLE BANDGAP REFERENCE VOLTAGE

(71) Applicant: ADVANCED MICRO DEVICES, INC., Sunnyvale, CA (US)

(72) Inventors: Raymond Louis Barrett, Jr., Fort Lauderdale, FL (US); Mark Chirachanchai, Stow, MA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 14/503,097

(22) Filed: Sep. 30, 2014

(65) Prior Publication Data

US 2015/0102856 A1 Apr. 16, 2015

Related U.S. Application Data

(60) Provisional application No. 61/891,810, filed on Oct. 16, 2013.

(51) Int. Cl.

| | |
|---|---|
| ***G05F 1/10*** | (2006.01) |
| ***G05F 3/16*** | (2006.01) |
| ***G05F 3/30*** | (2006.01) |

(52) U.S. Cl.

CPC ... *G05F 3/16* (2013.01); *G05F 3/30* (2013.01)

(58) Field of Classification Search

CPC ..... G05F 1/565; G05F 1/567; G05F 3/30

See application file for complete search history.

(56) References Cited

U.S. PATENT DOCUMENTS

| | | | | |
|---|---|---|---|---|
| 6,329,804 | B1 * | 12/2001 | Mercer | G05F 3/30 323/314 |
| 6,844,711 | B1 * | 1/2005 | Sutardja | G05F 3/30 323/313 |
| 6,958,643 | B2 * | 10/2005 | Rosenthal | G05F 3/30 323/313 |
| 7,482,797 | B2 * | 1/2009 | Cave | G05F 3/30 323/313 |
| 7,564,225 | B2 * | 7/2009 | Moraveji | G05F 3/30 323/223 |
| 8,269,478 | B2 * | 9/2012 | Chao | G05F 3/30 323/313 |
| 8,680,839 | B2 * | 3/2014 | Venkiteswaran S. | G05F 3/30 323/311 |
| 8,836,315 | B2 * | 9/2014 | Satoh | G05F 3/30 323/316 |
| 2011/0037451 | A1 * | 2/2011 | Shiina | G05F 3/30 323/313 |
| 2013/0234692 | A1 * | 9/2013 | Liang | G05F 3/242 323/304 |

* cited by examiner

*Primary Examiner* — Jeffrey Zweizig

(57) ABSTRACT

Embodiments may include a method, system and apparatus for providing a reference voltage supply. A series resistor is provided between a power supply and a bandgap circuit coupled to an amplifier. A shunt transistor circuit is operatively coupled to the series resistor. A programmable output voltage is provided based upon the shunt transistor circuit and a first value of the series resistor.

17 Claims, 6 Drawing Sheets

PROGRAMMABLE BANDGAP REFERENCE VOLTAGE

The present application claims the benefit under 35 U.S.C. §119(e) of prior-filed provisional application 61/891,810, filed Oct. 16, 2013, the disclosure of which is incorporated by reference herein.

BACKGROUND OF THE INVENTION

1. Field of the Disclosure

This application relates generally to voltage supply, and, more particularly, to reference voltage supply using a bandgap circuit.

2. Description of Related Art

There have been many developments in the area of supplying operating voltage for integrated circuit devices. Electronic devices generally require stable supplies voltage signals for proper operation. Many devices, such as processors, communication devices, etc., have various electronic components that operate using a predetermined input supply of voltage. Disruption in the voltage supply could be problematic for device components relying on uninterrupted power.

Frequently, the input power supply is generally provided by a circuit that is directed to provide a steady reference voltage for various electronic components to utilize for operations. Often, the input supply voltage that is directed to provide a stable reference voltage may be interrupted and/or may change value. Further, external factors, such as changes in temperature or other operation conditions, e.g., load conditions, may also affect the operation of a circuit that provides a reference voltage.

Further, designers generally implement a bias voltage circuitry into a circuit that provides a reference voltage during power up. That is, a start-up circuitry is generally used to provide a bias voltage for a circuit that provides a stable reference voltage for other components to utilize. Generally, in the state-of-the-art, the value of the reference voltage provided by a circuit may be predetermined based upon the values of various components that are utilized in the circuit, such as resistor values. However, this predetermined application of a reference voltage circuit may be susceptible to input power supply changes, load changes, temperature changes, etc. For example, temperature fluctuations may cause the output voltage of a reference voltage supply circuit to change, which may cause operational problems for various components utilizing the reference voltage.

Moreover, changes in the supply voltage and/or temperature relating to the circuit that provides the reference voltage may also cause instability in the output voltage that is provided to various components. These fluctuations may cause errors in the operation of various components, such as memory devices, communication devices, analog digital converters, etc. Further, if the supply voltage or the temperature variations cause a reduction in the reference voltage provided by a circuit, the output of the circuit providing the reference voltage may be lowered such that components that utilize the reference voltage may experience operation errors.

SUMMARY OF EMBODIMENTS

The following presents a simplified summary of the disclosed subject matter in order to provide a basic understanding of some aspects of the disclosed subject matter. This summary is not an exhaustive overview of the disclosed subject matter. It is not intended to identify key or critical elements of the disclosed subject matter or to delineate the scope of the disclosed subject matter. Its sole purpose is to present some concepts in a simplified form as a prelude to the more detailed description that is discussed later.

Some embodiments may include a method for providing a reference voltage supply. A series resistor is provided between a power supply and a bandgap circuit coupled to an amplifier. A shunt transistor circuit is operatively coupled to the series resistor. A programmable output voltage is provided based upon the shunt transistor circuit and a first value of the series resistor.

Some embodiments may include an integrated circuit device for providing a reference voltage supply. The integrated circuit device comprises a voltage module. The voltage module includes a bandgap circuit; an amplifier operatively coupled to the bandgap circuit; and a series resistor operatively coupled in series with the bandgap circuit and an input power supply node. The voltage module is configured to provide a self-starting programmable output voltage based upon the shunt transistor circuit and a first value of the series resistor.

Some embodiments may include a system for providing a reference voltage supply. The system comprises a power supply unit to provide an input voltage supply; and a processor comprising a reference voltage module. The reference voltage module also comprises: a bandgap circuit; an amplifier operatively coupled to the bandgap circuit, the amplifier is configured to perform an error correction amplification; and a series resistor operatively coupled in series with the bandgap circuit and a node of the power supply unit. The voltage module is configured to provide a programmable output voltage based upon the bandgap circuit, the amplifier, the shunt transistor circuit, and a first value of the series resistor. The system also comprises at least one integrated circuit component capable of receiving the programmable output voltage to perform an operation.

BRIEF DESCRIPTION OF THE DRAWINGS

The disclosed subject matter may be understood by reference to the following description taken in conjunction with the accompanying drawings, in which like reference numerals identify like elements, and in which.

Figure 1:
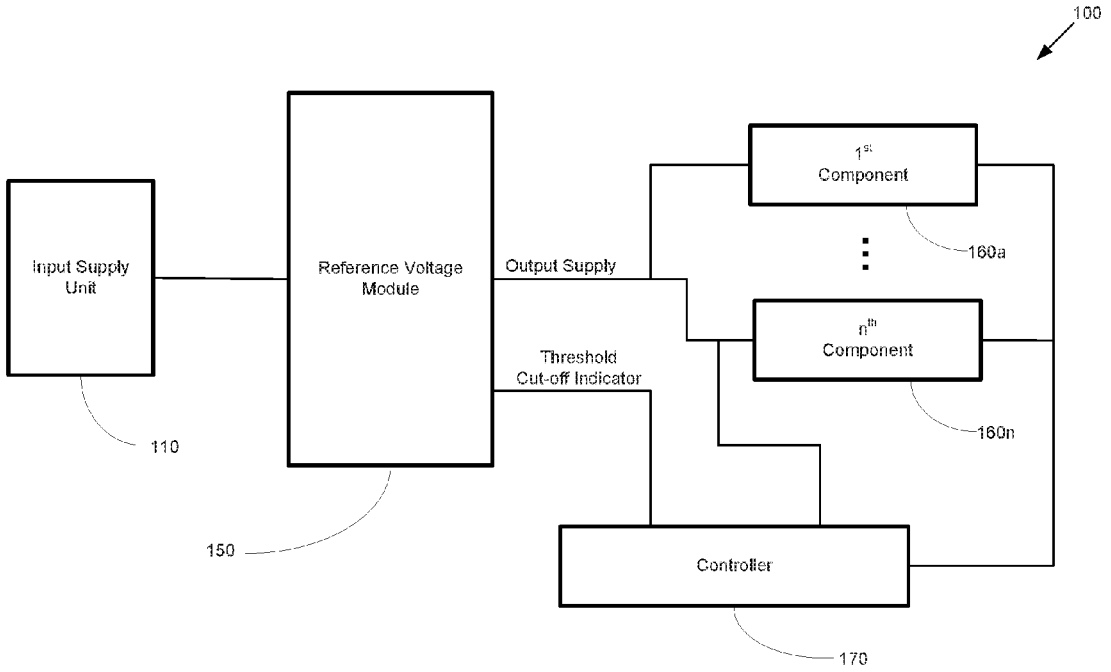
FIG. 1 illustrates a stylized block diagram depiction of a system for providing a reference supply voltage, in accordance with embodiments herein.

While the disclosed subject matter may be modified and may take alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the scope of the appended claims.

DETAILED DESCRIPTION

Illustrative embodiments are described below. In the interest of clarity, not all features of an actual implementation are described in this specification. It should be appreciated that in the development of any such actual embodiment, numerous implementation-specific decisions should be made, which may vary from one implementation to another. Moreover, it should be appreciated that such a development effort might be complex and time-consuming, but would nevertheless be a routine undertaking for those of ordinary skill in the art having the benefit of this disclosure. The description and drawings merely illustrate the principles of the claimed subject matter. It should thus be appreciated that those skilled in the art may be able to devise various arrangements that, although not explicitly described or shown herein, embody the principles described herein and may be included within the scope of the claimed subject matter. Furthermore, all examples recited herein are principally intended to be for pedagogical purposes to aid the reader in understanding the principles of the claimed subject matter and the concepts contributed by the inventor(s) to furthering the art, and are to be construed as being without limitation to such specifically recited examples and conditions. The word "exemplary" is intended to serve as one example and not to limit the application by construing the example or embodiment as preferred or advantageous over other embodiments.

The disclosed subject matter is described with reference to the attached figures. Various structures, systems and devices are schematically depicted in the drawings for purposes of explanation only and so as to not obscure the description with details that are well known to those skilled in the art. Nevertheless, the attached drawings are included to describe and explain illustrative examples of the disclosed subject matter. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition is expressly set forth in the specification in a definitional manner that directly and unequivocally provides the special definition for the term or phrase. Additionally, the term, "or," as used herein, refers to a non-exclusive "or," unless otherwise indicated (e.g., "or else" or "or in the alternative"). Also, the various embodiments described herein are not necessarily mutually exclusive, as some embodiments can be combined with one or more other embodiments to form new embodiments.

FIG. 1 illustrates a system for providing a reference supply voltage for a plurality of components, in accordance with some embodiments herein. The system 100 may comprise an input supply unit 110 that is capable of providing an input power supply to a reference voltage module 150. The reference voltage module 150 is capable of providing an output voltage supply to a plurality of components, i.e., a $1^{st}$ component 160*a* through an $n^{th}$ component 160*n*. The components 16*a-n* may be integrated circuit devices or modules within an integrated circuit device. For example, $1^{st}$ through $n^{th}$ components 160*a-n* may be a variety of electronic components within a processor, or alternatively, within a circuit (e.g., the motherboard of a computer system), such as a circuit that comprises a processor, a memory, a communications unit, etc. As an exemplary illustration, the $1^{st}$ component 160*a* may be a memory device, and the 160*n* may be an analog-to-digital (A/D) converter.

In one embodiment, the reference voltage module 150 is capable of monitoring the power supply to ensure that if the reference voltage falls below a predetermined threshold, a threshold cut-off indication signal may be provided. The threshold cutoff indication signal provides an indication (e.g., to a processor) whether sufficient power from the power supply is being provided to various components that utilize the output supply. The system 100 may comprise a controller 170 that is capable of detecting whether sufficient supply is being provided to the various components based upon the threshold cut-off indicator signal. Depending on the value of the threshold cut-off indicator signal, the controller 170 may activate the components 160*a-n* if the signal indicates that sufficient power is being provided, or alternatively, deactivate the components 160*a-n* if the signal indicates that insufficient power is being provided. The controller 170 may then provide a status signal indicating whether or not the voltage supply being provided to the various components 160*a-n* is sufficient. In some embodiments, the threshold cutoff indication signal may be used for an under-voltage lockout (UVLO) function. That is, based upon the threshold cutoff indication signal, one or more components of the system 100 may be locked-out of operation until an indication that the reference voltage supply is above a predetermine threshold is provided. The controller 170 may lockout one or more components 160*a-n* individually, or together using one or more component control signal(s), as shown in FIG. 1. For example, the controller 170 may determine that some of the components 160 may be capable of operating under a specific voltage condition, but may shut down other components 160 under that condition.

In one embodiment, the controller 170 may be a CPU, a processor or a processor core. The reference voltage module 150 may comprise various circuitry (described in further details below) that are capable of maintaining a relatively stable reference supply voltage for operation of the $1^{st}$ through $n^{th}$ components 160*a-n*. In some embodiments, the controller 170 may also utilize the output supply from the reference voltage module 150.

Further, the reference voltage module 150 is capable of self-starting for providing output supply voltage. Generally, the output voltage may be programmable to have one or various values, in most cases above the bandgap voltage. The self-starting feature of the reference voltage module 150 allows for omitting a start up circuit. Further, the reference voltage module 150 is capable of providing more than one reference voltage supply. More detailed descriptions of the reference voltage module 150 are provided in FIGS. 2, 3, and 5-6, and accompanying description below.

The bandgap voltage reference provided by the reference voltage module 150 may comprise one or more substantially fixed, constant voltage(s) and their stability may withstand many variations, such as variations in the power supply from the input supply unit 110, temperature variations experienced by the reference voltage module 150, loading changes, etc. In one embodiment, the term "bandgap voltage reference" may refer to voltage reference that may be independent of power supply variations, temperature changes, and/or loading on a device. The circuitry in the reference voltage module 150 may generate a proportional to absolute temperature (PTAT) current, as well as a complimentary to absolute temperature (CTAT) current, which may be reduced in inverse proportion to increasing temperature. The PTAT and CTAT currents may be used to maintain a relatively steady supply voltage despite any fluctuations in the power supply of operating temperature.

Figure 2:
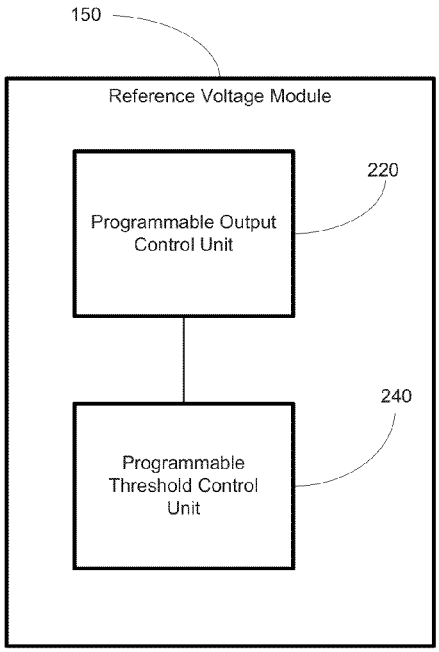
FIG. 2 illustrates a stylized block diagram depiction of a portion of the reference voltage module of FIG. 1, in accordance with embodiment herein.

Turning now to FIG. 2, a stylized block diagram depiction of a portion of the reference voltage module 150, in accordance with some embodiment herein, is illustrated. The reference voltage module 150 may comprise a programmable output control unit 220 and a programmable threshold control unit 240. In some embodiments, some or substantially all of the circuitry of the unit 220 may be shared with the unit 240. The programmable output control unit 220 is capable of generating a programmable output reference voltage. In one embodiment, the output reference voltage may be modified by the programmable output control unit 220, based on one of many factors, such as an external control signal instructing the change in the output voltage, changes in the input power supply, adjustments to operation conditions, environmental conditions, such as temperature changes, etc.

The programmable output control unit 220 may also be capable of providing a self-starting reference voltage output thereby obviating the need for a separate self-starting circuitry. The programmable threshold control unit 240 is capable of a programmable threshold to use to monitor the power supply. In the event that the output provided by the reference voltage module 150 falls below a predetermined threshold, due to one or more factors (e.g., problems with the input supply, temperature changes, etc.), a status signal may be provided to a controller 170 indicating that the output power is below the threshold, or outside a reference window. Once the output of the reference voltage module 150 is above the predetermined threshold, or within the reference window, the status signal indicating as such may be used by the controller 170 to prompt the initiation of operations of various components 160 in the system 100.

Figure 3:
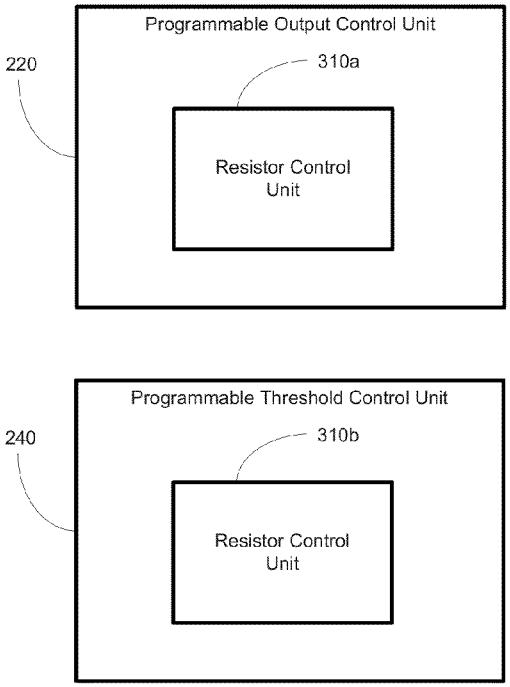
FIG. 3 illustrates a stylized block diagram depiction of a programmable output control unit and a programmable threshold unit, in accordance with embodiments herein.

FIG. 3 illustrates a stylized depiction of the programmable output control unit 220 and the programmable threshold unit 240, in accordance with some embodiments herein. Referring simultaneously to FIGS. 2 and 3, the programmable output control unit 220 and the programmable threshold control unit 240 may comprise a resistor control unit 310*a*, 310*b*, respectively, that are capable of modifying one or more resistors of the units 220 and 240. Changing values of the resistors in the circuitry of the unite 220, 240 may be performed by the resistor control unit 310*a-b*, using at least one of switches, transistors, decoder, etc., to control the resistor values. Controlling the resistor values may provide for adjusting the output supply of the reference voltage module 150, as well as adjusting the thresholds associated with the programmable threshold control unit 240. Further details of the reference voltage module 150 are provided in FIGS. 5 and 6, and accompanying description below.

Figure 4:
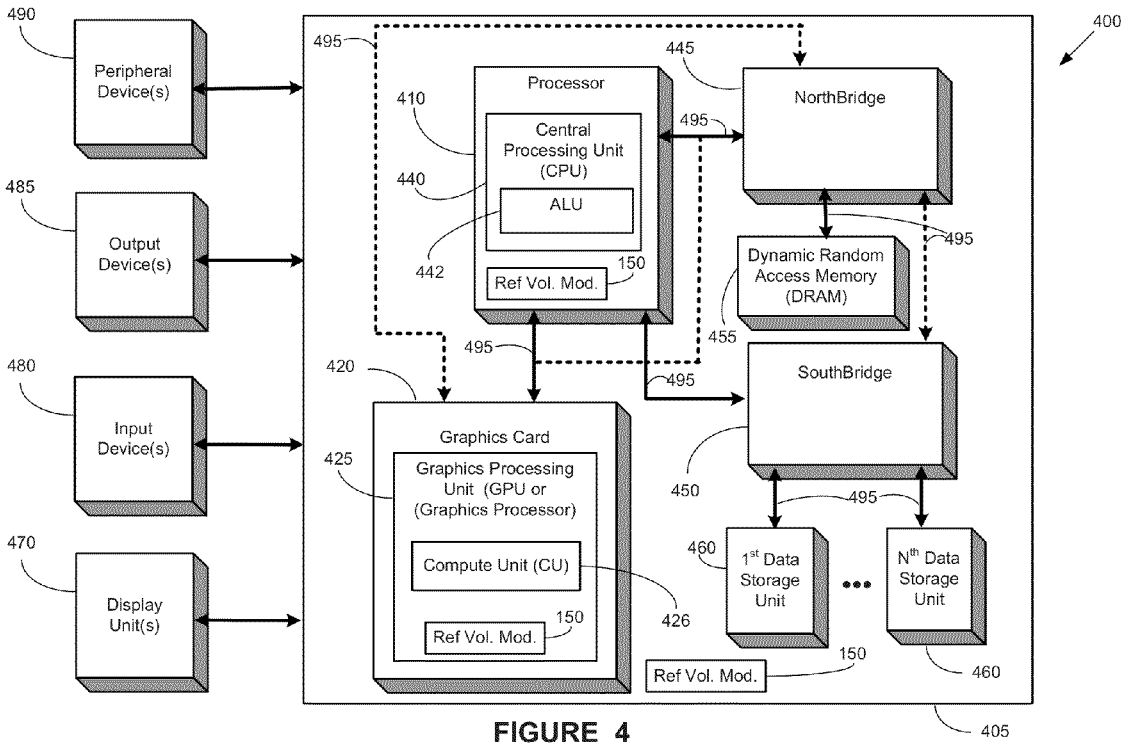
FIG. 4 illustrates a stylized block diagram depiction of a system comprising a processor and a graphics card in accordance with embodiments herein.

Turning now to FIG. 4, a system comprising a processor and a graphics card in accordance with some embodiments herein is illustrated. FIG. 4 conceptually illustrates a computer system 400, according to some embodiments. The computer system 400 comprises various components that operate using a stable reference voltage signal provided by a module similar to the reference voltage module 150 described herein. In many cases, various components of the computer system 400 may not be brought-up until a signal from a reference voltage module 150 is received indicating that the voltage supply provided by the reference voltage module 150 is above a predetermined threshold. Moreover, in some embodiments, if the voltage supply provided by the reference voltage module 150 fall below the predetermined threshold, various components of the computer system 400 may be locked out from operation.

The computer system 400 may be a personal computer, a laptop computer, a handheld computer, a netbook computer, a mobile device, a tablet computer, a netbook, an ultrabook, a telephone, a personal data assistant (PDA), a server, a mainframe, a work terminal, a smart television, or the like. The computer system includes a main structure 405 which may be a computer motherboard, system-on-a-chip, circuit board or printed circuit board, a desktop computer enclosure or tower, a laptop computer base, a server enclosure, part of a mobile device, tablet, personal data assistant (PDA), or the like. The computer system 400 may run an operating system such as Linux®, Unix®, Windows®, Mac OS®, or the like.

In some embodiments, the main structure 405 includes a graphics card 420. For example, the graphics card 420 may be an ATI Radeon™ graphics card from Advanced Micro Devices ("AMD"). The graphics card 420 may, in different embodiments, be connected on a Peripheral Component Interconnect (PCI) Bus (not shown), PCI-Express Bus (not shown), an Accelerated Graphics Port (AGP) Bus (also not shown), or other electronic or communicative connection. The graphics card 420 may include a graphics processing unit (GPU) 425 used in processing graphics data. The graphics card 420 may be referred to as a circuit board or a printed circuit board or a daughter card or the like.

The computer system 400 may comprise a processor 410, in accordance with some embodiments, is illustrated. Modern computer systems may exist in a variety of forms, such as telephones, tablet computers, desktop computers, laptop computers, servers, smart televisions, or other consumer electronic devices. The processor unit 410 may comprise one or more central processing units (CPUs) 440. The CPU 440 is capable of performing memory operations using the unified store queue taught herein.

The CPU(s) 440 may be electronically or communicatively coupled to a northbridge 445. The CPU 440 and northbridge 445 may be housed on the motherboard (not shown) or some other structure of the computer system 400. In some embodiments, the graphics card 420 may be coupled to the CPU 440 via the northbridge 445 or some other electronic or communicative connection. For example, CPU 440, northbridge 445, GPU 425 may be included in a single package or as part of a single die or "chip". The northbridge 445 may be coupled to a system RAM (or DRAM) 455 or the system RAM 455 may be coupled directly to the CPU 440. The system RAM 455 may be of any RAM type known in the art; the type of system RAM 455 may be a matter of design choice. The northbridge 445 may be connected to a southbridge 450. The northbridge 445 and southbridge 450 may be on the same chip in the computer system 400, or the northbridge 445 and southbridge 450 may be on different chips. The southbridge 450 may be connected to one or more data storage units 460. The data storage units 460 may be hard drives, solid state drives, magnetic tape, or any other non-transitory, writable media used for storing data. In various embodiments, the CPU 440, northbridge 445, southbridge 450, GPU 425, or system RAM 455 may be a computer chip or a silicon-based computer chip, or may be part of a computer chip or a silicon-based computer chip. The various components of the computer system 400 may be operatively, electrically, or physically connected or linked with a bus 495 or more than one bus 495. Some embodiments of the buses 495 may be result buses that are used to convey results of operations performed by one functional entity in the computer system 400 to another functional entity in the computer system 400.

The computer system 400 may be connected to one or more display units 470, input devices 480, output devices 485, or peripheral devices 490. These elements may be internal or external to the computer system 400, and may be wired or wirelessly connected. The display units 470 may be internal or external monitors, television screens, handheld device displays, touchscreens, and the like. The input devices 480 may be any one of a keyboard, mouse, track-ball, stylus, mouse pad, mouse button, joystick, touchscreen, scanner or the like. The output devices 485 may be any one of a monitor, printer, plotter, copier, or other output device. The peripheral devices 490 may be any other device that can be coupled to a computer. Example peripheral devices 490 may include a CD/DVD drive capable of reading or writing to physical digital media, a USB device, Zip Drive, external hard drive, phone or broadband modem, router/gateway, access point or the like.

The GPU 425 and the CPU 440 may implement various functional entities including one or more processor cores, floating-point units, arithmetic logic units, load store units, translation lookaside buffers, instruction pickers, or caches such as L1, L2, or L3 level caches in a cache hierarchy.

In one embodiment, the main structure 405 of the computer system 400 may comprise one or more reference voltage modules 150. As an illustrative example, the processor 110 may comprise a reference voltage module 150 that may provide various reference voltage supply, as well as under-voltage warning signal(s) described herein. Additionally, or alternatively, external to the processor 100, the main structure 405 may comprise a reference voltage module 150 that may be capable of providing a reference voltage supply to various portions of the main structure 405, such as the DRAM 455, the data storage unit 460, the Northbridge 445, the Southbridge 450, etc. Further, in some embodiments, the graphics card 420 may comprise a reference voltage module 150 in order to provide a reference voltage and/or threshold warning to the GPU 125 to compute unit CU 426, etc. As such, embodiments provided herein may be implemented in a processor, graphics card, computer systems, etc.

Figure 5:
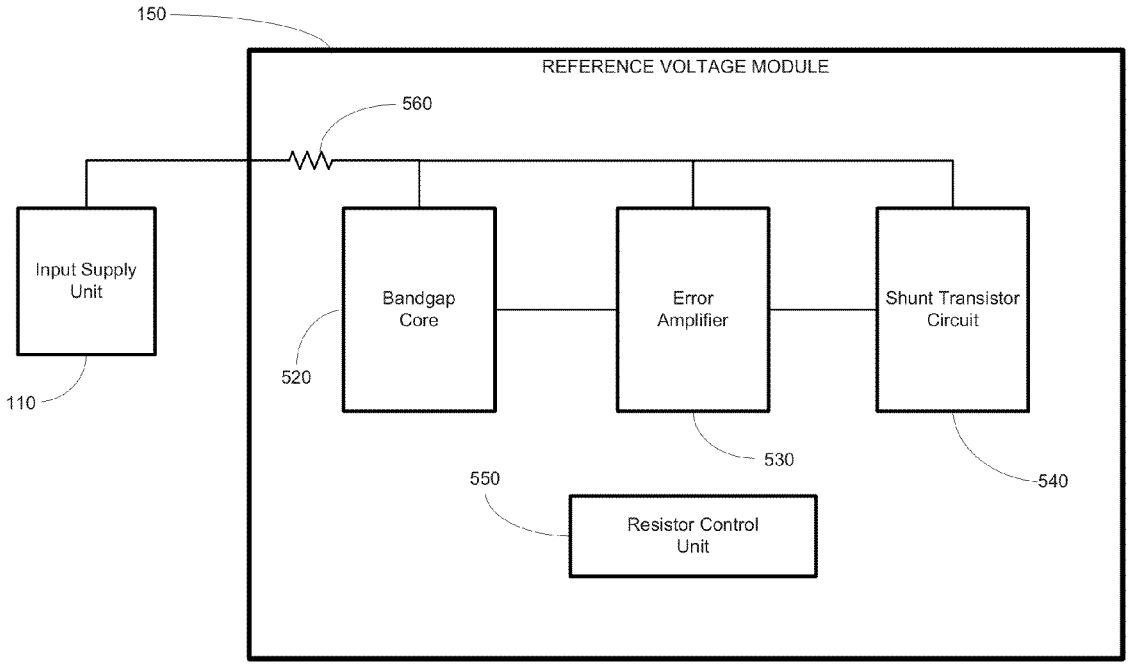
FIG. 5 illustrates a stylized block diagram depiction of the reference voltage module of FIG. 1, in accordance with the embodiments herein.
Figure 6:
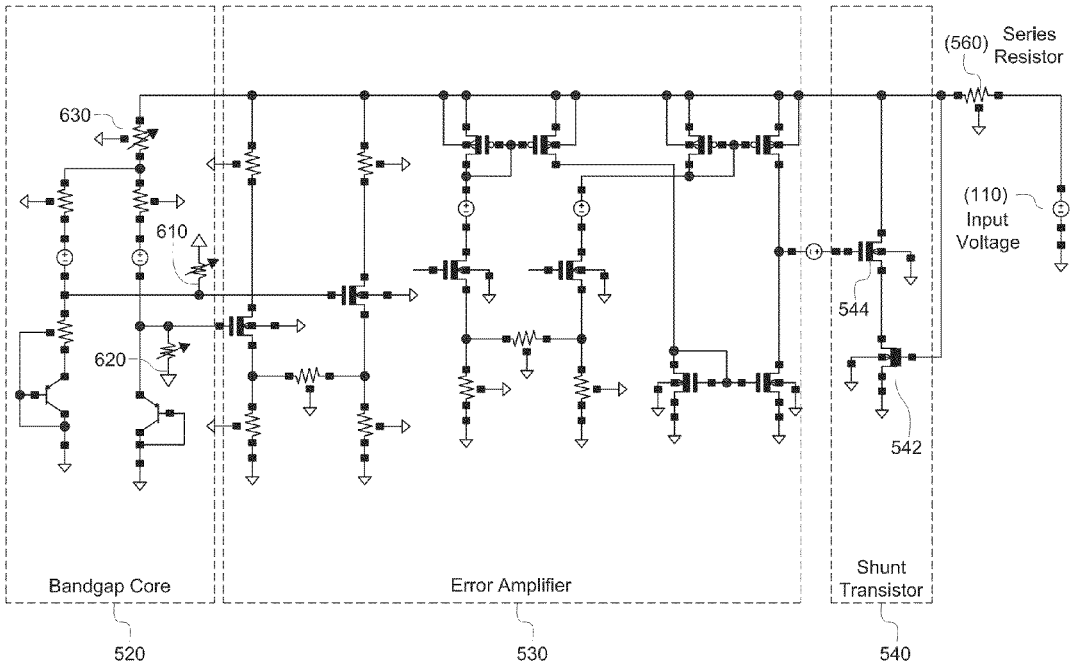
FIG. 6 illustrates an exemplary circuit implementation of the reference voltage module of FIG. 5, in accordance with some embodiments herein.

Turning now to FIG. 5, a stylized block diagram depiction of the reference voltage module 150, in accordance with embodiments herein, is illustrated. FIG. 6 illustrates an exemplary circuit implementation of the reference voltage module 150 in accordance with some embodiments herein. As depicted in FIG. 5, the reference voltage module 150 may receive input power from the input supply unit 110. Further, the reference voltage module 150 may provide an output supply, i.e., reference voltage signal supply, for usage by various components in the system 100. The reference voltage module 150 may comprise a bandgap core 520, an error amplifier 530, a shunt transistor circuit 540, and a resistor control unit 550. In one embodiment, the resistor control unit 550 illustrated of FIG. 5 may encompass the resistor control units 310*a* and 310*b* illustrated in FIG. 3.

In accordance with embodiments herein, the bandgap core 520 may provide a fixed reference voltage that is substantially stable with temperature variations, input supply variations, load variations, etc. Generally, the bandgap core 520 may utilize bipolar junction transistors (BJT) arranged in differential common-mode and current mirror configurations. The bandgap core 520 may provide proportional-to-absolute-temperature (PTAT) current as well as complementary-to-absolute-temperature (CTAT) current and combine them to yield a reference voltage that is substantially stable in the face of temperature variations and/or input supply variations. In some embodiments, the PTAT and the CTAT are summed.

The bandgap core 520 may comprise a plurality of resistors in combination with a plurality of transistors, along with a gain stage to generate the reference voltage supply. The reference voltage supply may be substantially equal to the bandgap voltage of the semiconductor material used in the reference voltage module 150. The gain stage may be provided by the error amplifier 530. The error amplifier 530 may provide for regulating and maintaining the output reference voltage.

In one embodiment, the reference voltage module 150 may utilize a resistor 560 (Rs) that is in series with the input supply to the bandgap core 520. Moreover, the reference voltage module 150 may comprise a shunt transistor circuit 540, which may be operatively coupled to a node of the series resistor 560. The shunt transistor circuit 540 may provide a voltage regulation function that may be programmable. The regulation function provided by the shunt transistor circuit 540 may behave as a bandgap Zener-diode that conducts strongly at or above the reference voltage. In one embodiment, the Zener behavior is generated using an NMOS switch 542 (FIG. 6). The NMOS switch turns on when the bandgap core voltages cross.

In one embodiment, the series resistor (Rs) 560 and the shunt transistor 540 may generate the reference voltage. Current across the shunt resistor causes IR drop. The bandgap core 520 and the error amplifier 530 work together to set the current across the resistor 560 to set the voltage at the other side of the resistor 560. The bandgap core 560 may comprise diode voltages that when cross, the shunt transistor circuit 540 may turn on. When the shunt transistor circuit 540 turns on, the current that runs through the series transistor 560 may generate the reference voltage at band gap voltage. The error amplifier changes the resistance of another an NMOS switch 544 (FIG. 6) to force the reference voltage to the programmed value. This provides a reference voltage supply at substantially the bandgap voltage, and may be substantially stable under various factors, such as changes in the supply voltage 110, environmental changes, such as temperature changes, etc. However, those skilled in the art would recognize that if the supply voltage falls substantially low, the reference voltage supply may also fall below a predetermined threshold.

Continuing referring simultaneously to FIGS. 5 and 6, the series resistor 560 is shown in series with the input voltage 110. In one embodiment, the shunt transistor circuit 540 is implemented using a field effect transistor (FET) arrangement, which is coupled to a node of the series resistor 560.

Moreover, FIG. 6 illustrates a PTAT resistor 630 and CTAT resistors 610, 620. The values of the PTAT resistor 630 and the CTAT resistors 610, 620 may be selected to modify the trip point of the bandgap voltage. Therefore, a modified reference voltage may be provided in relation to the trip point of the bandgap voltage by adjusting the values of the resistors 610, 620 and 630. Adjustment of resistor values may be performed by the resistor control unit 550. One or more switches, transistors, and/or decode circuitry may be used to control the value of the resistors 610 and 620.

In some embodiments, one or more of the resistors 610, 620 and 630 may be variable resistors that may be adjusted to control the threshold for performing an under-voltage lockout function, i.e., under-voltage threshold. For example, one or more components of the system 100 may be locked-out of operation until an indication that the reference voltage supply is not below a predetermined threshold is provided. The value of the resistors may be controlled in order to control the under-voltage threshold. In one embodiment, under-voltage lock-out threshold may be determined by programmable threshold control unit 240, wherein the unit 240 may be able to adjust the value of one or more variable resistors in order to set the under-voltage lock-out threshold. In another embodiment, the reference voltage module 150 may not comprise the shunt transistor circuit 540 and the series resistor 560. In this embodiment, the bandgap core 520 and the error amplifier 530 are capable of providing a substantially steady reference voltage for a plurality of components 160 despite varying temperature coefficients and/or supply voltages. When the supply voltage rises above a predetermined set point, the bandgap core 520 and the error amplifier 530 are capable of providing a substantially stable reference voltage signal. For example, for a first temperature range or coefficient, the respective values of PTAT resistor 630 and the CTAT resistors 610, 620 may be adjusted to a first set of predetermined values to provide a substantially stable reference voltage output. For a second temperature range or coefficient, the respective values of PTAT resistor 630 and the CTAT resistors 610, 620 may be adjusted to a second set of predetermined values to provide a substantially stable reference voltage output.

Moreover, one or more of the series resistor 560, the PTAT resistor 630, and the CTAT resistor 610, 620 may be resistors that are formed using transistors. Various combinations of components known to those skilled in the art, having the benefit of the present disclosure may be used to adjust and control the values of the resistors 560, 610, and 620. In some embodiments, when the bandgap trip point is adjusted, the reference voltage module 150 may still maintain a consistent temperature coefficient on the output, thereby reducing variation in the reference voltage supply despite fluctuating temperatures.

The resistive biasing provides for a self-starting rise of the reference voltage supply, which negates the requirement of a separate self-start circuitry. Accordingly, the bias voltage needed for startup of various components in the system 100 is provided by the reference voltage module 150.

Further, the circuitry of the reference voltage module 150 is capable of monitoring the power supply and can provide a signal indicating that the power supply has reached a predetermined voltage that is sufficient for supporting operations of various portions of the system 100. The level of the predetermined voltage may be adjusted based upon the adjustment of the various resistors (560, 610, 620 and 630) described herein. In one embodiment, the resistor control unit 550 is capable of adjusting one or more of the resistors 560, 610, and 620.

The circuit of the reference voltage module 150 may provide for adjusting the reference voltage to one of a plurality of values above the bandgap voltage. The self-starting capabilities provided by the resistive biasing provides for a self-starting capability that would make power-up of a device more reliable Those skilled in the art would appreciate that other types of bandgap core amplifiers and transistor arrangement may be utilized within the context of the embodiments herein and remain within the spirit and scope of the embodiments herein. Further, those skilled in the art would appreciate that the reference voltage module 150 may be arranged in a variety of integrated circuit devices (e.g., processors, memory devices, digital signal processors, micro-controller, etc.) and remain within the spirit and scope of embodiments herein.

In one embodiment, the CTAT characteristic is a curve that intersects the voltage associated with the bandgap potential of the semiconductor at Ok temperature. At differing current densities, the junctions of all devices of the same construction on an integrated circuit may exhibit differing slopes that all approach asymptotically and intersect at the same potential (voltage) at 0 Kelvin (absolute zero). Two or more devices with differing current densities may be used to develop the PTAT difference (diverging as temperature increases). Embodiments herein provide for a combined, scaled CTAT and PTAT behavior signals to obtain relatively constant characteristics for use as a reference, essentially any temperature slope desired over a predetermined range), but in some embodiments, tailored for substantially any temperature first-order slope. Embodiments herein provide for using two or more such nearly independent reference levels with a single hardware circuit (e.g., the circuit of FIGS. 5 and 6). This may provide the advantage disclosed that difference in the reference levels may be used to provide a turn-ON/turn-OFF difference for a "tailored" switching hysteresis, wherein the hysteresis magnitude may be temperature independent or tailored as desired. In many instances, the UVLO hysteresis value may be a useful parameter for avoiding power-supply noises from switching functions ON/OFF near the decision value, and thus rejecting undesired oscillatory switching at that decision.

Figure 7:
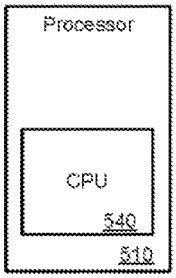
FIG. 7 provides a representation of a processor depicted in FIG. 4, in accordance with some embodiments.
Figure 8A:
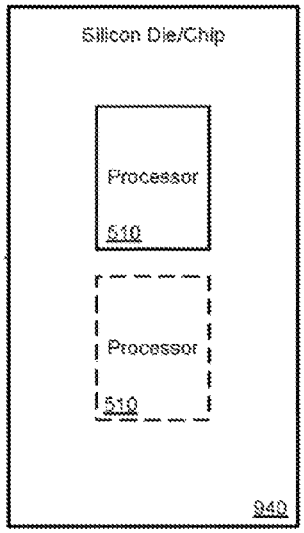
FIG. 8A provides a representation of a silicon die/chip that includes one or more circuits as shown in FIG. 5, in accordance with some embodiments.
Figure 8B:
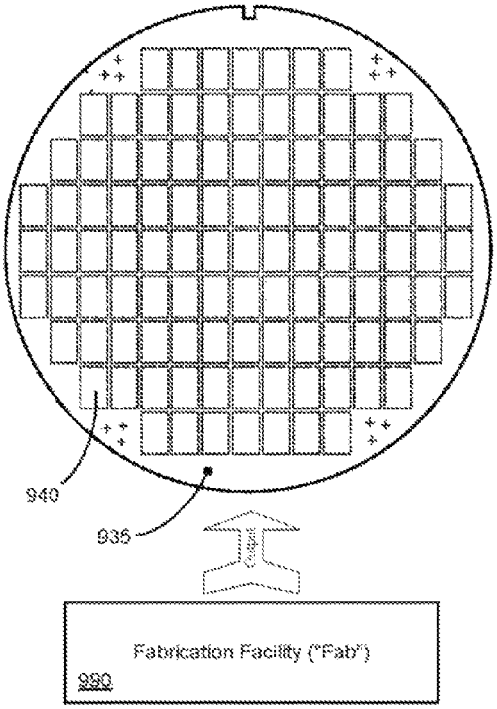
FIG. 8B provides a representation of a silicon wafer which includes one or more dies/chips that may be produced in a fabrication facility, in accordance with some embodiments.

FIG. 7 provides a representation of a processor depicted in FIG. 4, in accordance with some embodiments. FIG. 8A provides a representation of a silicon die/chip that includes one or more circuits as shown in FIG. 5, in accordance with some embodiments. FIG. 8B provides a representation of a silicon wafer which includes one or more dies/chips that may be produced in a fabrication facility, in accordance with some embodiments.

Turning now to FIG. 7 and FIG. 8A, in some embodiments, the processor 110 comprising a CPU 540 may reside on a silicon die/chip 540. The silicon die/chip 540 may be housed on a motherboard or other structure of the computer system 400. In some embodiments, there may be more than one processor 510 on each silicon die/chip 540. Some embodiments of the processor 510 may be used in a wide variety of electronic devices. In an alternative embodiment, the block CPU 540 may be a compute unit in a GPU, as exemplified in FIG. 4.

Turning now to FIG. 8B, in accordance with some embodiments, and as described above, the processor 510 may be included on the silicon chip/die 940. The silicon chip/die 940 may contain one or more different configurations of the processor 510. The silicon chip/die 940 may be produced on a silicon wafer 935 in a fabrication facility (or "fab") 990. That is, the silicon wafer 935 and the silicon die/chip 940 may be referred to as the output, or product of, the fab 990. The silicon chip/die 940 may be used in electronic devices.

The circuits described herein may be formed on a semiconductor material by any known means in the art. Forming may be done, for example, by growing or deposition, or by any other means known in the art. Different kinds of hardware descriptive languages (HDL) may be used in the process of designing and manufacturing the microcircuit devices. Examples include VHDL and Verilog/Verilog-XL. In some embodiments, the HDL code (e.g., register transfer level (RTL) code/data) may be used to generate GDS data, GDSII data and the like. GDSII data, for example, is a descriptive file format and may be used in some embodiments to represent a three-dimensional model of a semiconductor product or device. Such models may be used by semiconductor manufacturing facilities to create semiconductor products and/or devices. The GDSII data may be stored as a database or other program storage structure. This data may also be stored on a computer readable storage device (e.g., data storage units, RAMs, compact discs, DVDs, solid state storage and the like) and, in some embodiments, may be used to configure a manufacturing facility (e.g., through the use of mask works) to create devices capable of embodying various aspects of some embodiments. As understood by one or ordinary skill in the art, this data may be programmed into a computer, processor, or controller, which may then control, in whole or part, the operation of a semiconductor manufacturing facility (or fab) to create semiconductor products and devices. In other words, some embodiments relate to a non-transitory computer-readable medium storing instructions executable by at least one processor to fabricate an integrated circuit. These tools may be used to construct the embodiments described herein.

In one embodiment, a processor design can be represented as code stored on a computer readable media. Exemplary codes that may be used to define and/or represent the processor design may include HDL, Verilog, and the like. The code may be written by engineers, synthesized by other processing devices, and used to generate an intermediate representation of the processor design, e.g., netlists, GDSII data and the like. The intermediate representation can be stored on computer readable media and used to configure and control a manufacturing/fabrication process that is performed in a semiconductor fabrication facility. The semiconductor fabrication facility may include processing tools for performing deposition, photolithography, etching, polishing/planarizing, metrology, and other processes that are used to form transistors and other circuitry on semiconductor substrates. The processing tools can be configured and are operated using the intermediate representation, e.g., through the use of mask works generated from GDSII data.

Portions of the disclosed subject matter and corresponding detailed description are presented in terms of software, or algorithms and symbolic representations of operations on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

Note also that the software implemented aspects of the disclosed subject matter are typically encoded on some form of program storage medium or implemented over some type of transmission medium. The program storage medium may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The disclosed subject matter is not limited by these aspects of any given implementation.

Furthermore, the methods disclosed herein may be governed by instructions that are stored in a non-transitory computer readable storage medium and that are executed by at least one processor of a computer system. Each of the operations of the methods may correspond to instructions stored in a non-transitory computer memory or computer readable storage medium. In various embodiments, the non-transitory computer readable storage medium includes a magnetic or optical disk storage device, solid state storage devices such as Flash memory, or other non-volatile memory device or devices. The computer readable instructions stored on the non-transitory computer readable storage medium may be in source code, assembly language code, object code, or other instruction format that is interpreted and/or executable by one or more processors.

The particular embodiments disclosed above are illustrative only, as the disclosed subject matter may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed:

1. A method, comprising:

providing a series resistor between a power supply and a bandgap circuit coupled to an amplifier;

providing a shunt transistor circuit operatively coupled to said series resistor;

providing programmable output voltage based upon said shunt transistor circuit and a first value of said series resistor; and providing a variable resistor, wherein the value of at said variable resistor is adjustable for setting an under-voltage lockout threshold, wherein a circuit component is shut-down based upon a determination that said output voltage is below a predetermined threshold.

2. The method of claim 1, further comprising:

controlling a value of said series resistor to have said first value to provide said output voltage at a first voltage level;

controlling said value of said series resistor to have a second value to provide said output voltage at a second voltage; and wherein providing said output voltage at said first voltage level comprises providing said output voltage at a value substantially equal to a bandgap voltage.

3. The method of claim 1, further comprising performing an error correction amplification using said amplifier for maintaining the value of said output voltage.

4. The method of claim 1, further comprising providing a status signal indicative of whether said output voltage is above the predetermined threshold.

5. The method of claim 4, further comprising performing at least one of:

a start-up of a circuit component in response to a determination that said output voltage is above said predetermined threshold, or a shut-down of said circuit component in response to a determination that said output voltage is below said predetermined threshold.

6. The method of claim 1, further comprising generating a proportional-to-absolute-temperature (PTAT) current and a complementary-to-absolute-temperature (CTAT) current for providing said output voltage substantially independent of temperature variations.

7. An integrated circuit device, comprising:

a voltage module, comprising:

a bandgap circuit;

an amplifier operatively coupled to said bandgap circuit; and a series resistor operatively coupled in series with said bandgap circuit and an input power supply node;

wherein said voltage module is configured to provide a self-starting programmable output voltage based upon a shunt transistor circuit and a first value of said series resistor; and a variable resistor, wherein the value of said variable resistor is adjustable for setting an under-voltage lockout threshold, wherein a circuit component is shut-down based upon a determination that said output voltage is below said under-voltage lockout threshold.

8. The integrated circuit device of claim 7, further comprising a resistor control unit configured to control the value of said series resistor.

9. The integrated circuit device of claim 8, wherein said resistor control unit is capable of controlling a value of said series resistor to have at least one of a first value to provide said output voltage at a first voltage level, or a second value to provide said output voltage at a second voltage level.

10. The integrated circuit device of claim 9, wherein said output voltage at said first voltage level comprises providing said output voltage at a value substantially equal to a bandgap voltage.

11. The integrated circuit device of claim 7, wherein said amplifier is configured to perform an error correction amplification for maintaining the value of said output voltage.

12. The integrated circuit device of claim 7, wherein said voltage module is further configured to provide a status signal indicative of whether said output voltage is above a predetermined threshold.

13. The integrated circuit device of claim 12, wherein said voltage module is further configured to perform at least one of:

a start-up of a circuit component in response to a determination that said output voltage is above said predetermined threshold, or a lock down of said circuit component in response to a determination that said output voltage is below said predetermined threshold.

14. The integrated circuit device of claim 7, wherein said bandgap circuit is configured to generate a proportional-to-absolute-temperature (PTAT) current and a complementary-to-absolute-temperature (CTAT) current for providing said output voltage substantially independent of temperature variations.

15. The integrated circuit device of claim 14, wherein said voltage module further comprises a PTAT resistor for controlling the value of said PTAT current and a CTAT resistor for controlling the value of said CTAT current, wherein said PTAT and said CTAT resistors are pulled up to a reference voltage.

16. A system, comprising:

a power supply unit to provide an input voltage supply;

a processor comprising a reference voltage module, comprising:

a bandgap circuit;

an amplifier operatively coupled to said bandgap circuit, said amplifier is configured to perform an error correction amplification; and a series resistor operatively coupled in series with said bandgap circuit and a node of said power supply unit;

wherein said voltage module is configured to provide a programmable output voltage based upon said bandgap circuit, said amplifier, a shunt transistor circuit, and a first value of said series resistor;

a resistor control unit configured to control the value of said series resistor, wherein said resistor control unit is capable of controlling a value of said series resistor to have at least one of said first value to provide said programmable output voltage at a first voltage, and a second value to provide said output voltage at a second voltage; and at least one integrated circuit component capable of receiving said programmable output voltage to perform an operation.

17. The system of claim 16, wherein said voltage module is further configured to provide a status signal to said processor, wherein said status signal is indicative of whether said output voltage is above a predetermined threshold, and wherein said processor is configured to perform at least one of:

a start-up of said at least one component in response to a determination that said output voltage is above said predetermined threshold;

a lock down of said at least one component in response to a determination that said output voltage is below said predetermined threshold; or modify a value of a variable resistor to determine a threshold for performing an under-value lock out of said at least one component.

* * * * *